US006915544B2

(12) United States Patent
Roney et al.

(10) Patent No.: US 6,915,544 B2
(45) Date of Patent: Jul. 12, 2005

(54) AGITATOR DRIVE SYSTEM WITH BARE FLOOR SHIFTER

(75) Inventors: Jeffrey T. Roney, Stanford, KY (US); Ron E. Davis, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 28 days.

(21) Appl. No.: 10/467,403

(22) PCT Filed: Mar. 19, 2002

(86) PCT No.: PCT/US02/08340

§ 371 (c)(1),
(2), (4) Date: Aug. 4, 2003

(87) PCT Pub. No.: WO02/080749

PCT Pub. Date: Oct. 17, 2002

(65) Prior Publication Data

US 2004/0078924 A1 Apr. 29, 2004

Related U.S. Application Data

(60) Provisional application No. 60/281,981, filed on Apr. 6, 2001.

(51) Int. Cl.[7] ..... A47L 9/04

(52) U.S. Cl. ..... 15/384; 15/389; 15/390; 15/391

(58) Field of Search ..... 15/384, 389, 390, 15/391, 41.1, 52.1, 50.3, 82

(56) References Cited

U.S. PATENT DOCUMENTS

| | | | |
|---|---|---|---|
| 1,333,226 | A | 3/1920 | Stoney |
| 1,759,881 | A | 5/1930 | Bentley |
| 3,148,400 | A | 9/1964 | Worwag |
| 3,624,861 | A | 12/1971 | Freiheit |
| 3,702,488 | A | 11/1972 | Kasper |
| 3,786,779 | A | 1/1974 | Brunel et al. |
| 3,950,809 | A | 4/1976 | Schatzmann |
| 4,426,751 | A | 1/1984 | Nordeen |
| 4,433,451 | A | 2/1984 | Parisi |
| 4,542,556 | A | 9/1985 | Hepple |
| 4,624,025 | A | 11/1986 | Kaulig et al. |
| 4,654,916 | A | 4/1987 | Postonen et al. |
| 4,748,714 | A | 6/1988 | Tschudy |
| 4,845,794 | A | 7/1989 | Korski et al. |
| 4,850,077 | A | 7/1989 | Venturini |
| 5,018,240 | A | 5/1991 | Holman |
| 5,077,862 | A | 1/1992 | Rench |
| 5,537,712 | A | 7/1996 | Weber et al. |
| 5,611,106 | A | 3/1997 | Wulff |
| 5,666,689 | A | 9/1997 | Andersen |
| 5,813,086 | A | 9/1998 | Ueno et al. |
| 5,974,622 | A | 11/1999 | Louis et al. |
| 6,030,465 | A | 2/2000 | Marcussen et al. |
| 6,131,238 | A | 10/2000 | Weber et al. |

FOREIGN PATENT DOCUMENTS

| | | | |
|---|---|---|---|
| GB | 2386055 | A | 9/2003 |

*Primary Examiner*—Theresa T. Snider
(74) *Attorney, Agent, or Firm*—King & Schickli, PLLC

(57) ABSTRACT

An upright vacuum cleaner includes a housing, a nozzle opening in the housing and a dust collector carried on the housing. A suction fan is also carried on the housing. The suction fan draws air, dirt and debris from a surface to be cleaned through the nozzle opening to the dust collector. The upright vacuum cleaner also includes a first rotary agitator and a second rotary agitator, both carried on the housing. A drive motor carried on the housing drives the first rotary agitator through the belt and pulley assembly. A gear drive assembly drivingly connects the first rotary agitator to the second rotary agitator.

23 Claims, 6 Drawing Sheets

20
10
18
22
32
12
16
46
46
35
34
50
14
30
38a
36
38b

AGITATOR DRIVE SYSTEM WITH BARE FLOOR SHIFTER

This application claims the benefit of U.S. Provisional Patent Application Ser. No. 60/281,981 filed Apr. 6, 2001.

TECHNICAL FIELD

The present invention relates generally to the carpet cleaner field, and, more particularly, to an agitator drive system for a power head, an upright vacuum cleaner or an extractor including twin agitators for brushing dirt and debris from a surface being cleaned.

BACKGROUND OF THE INVENTION

Upright vacuum cleaners and power heads for canister vacuum cleaners in all of their designs and permutations have become increasingly popular over the years. Upright vacuum cleaners generally incorporate a nozzle assembly which rides on wheels over the floor surface to be cleaned. A canister assembly is pivotally mounted to the nozzle assembly. The canister assembly includes an operating handle that is manipulated by the user to move the vacuum cleaner back and forth across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

Power heads generally include a nozzle opening, a rotary agitator in the nozzle opening and a motor for driving the rotary agitator through a drive transmission system. In either an upright vacuum cleaner/extractor nozzle or a power head assembly, as the single agitator rotates and engages the surface being cleaned, it has a tendency to pull or push forward or backward depending upon its direction of rotation. At certain times and under certain operating conditions, this imparted motion becomes a hindrance to the user's effective operation and directing of the upright vacuum cleaner/extractor or power head and impedes its ease of operation. In order to address this shortcoming, the present invention relates to a power head or upright vacuum cleaner/extractor incorporating twin agitators that may be made counter-rotating. In this way the net pulling and pushing effect of each agitator is effectively canceled to significantly ease manipulation of the power head or vacuum cleaner/extractor by the user. Additionally, the present invention relates to a unique, novel and efficient drive system for the twin agitators.

SUMMARY OF THE INVENTION

In accordance with the purposes of the present invention as described herein, an improved agitator drive system is provided. That agitator drive system includes a housing and a nozzle opening in the housing.

A first rotary agitator and a second rotary agitator are carried on the housing. Additionally, a drive motor is carried on the housing. A belt and pulley assembly connects the drive motor to the first rotary agitator. A gear drive assembly connects the first rotary agitator to the second rotary agitator. In this way a single motor drives both agitators.

Still more specifically describing the invention, the belt and pulley assembly includes a drive shaft, a drive pulley, a first belt connecting said drive shaft and drive pulley and a second belt connecting the drive pulley to the first rotary agitator. A pivotally mounted idler pulley is selectively displaceable between a first position wherein the idler pulley engages and tensions the second belt and a second position where the idler pulley releases tension from the second belt. When the first belt is tensioned by the idler pulley, the drive motor rotatably drives the first agitator. When the idler pulley is displaced to the second position, the slack in the belt interrupts the drive to the first agitator. Accordingly, the agitators are not rotated and only the suction fan is driven by the drive motor. This allows for more efficient bare floor cleaning.

The gear drive assembly includes a gear box and cooperating cover. A first drive gear of the gear box is connected to the first rotary agitator while a second drive gear of the gear box is connected to the second rotary agitator. In one embodiment, the gear drive assembly includes a single intermediate gear between the first and second drive gears whereby the first and second drive gears and therefore, the first and second agitators connected thereto, are made co-rotating. In a second embodiment, the gear drive assembly includes two intermediate gears between the first and second drive gears. In this arrangement, the first and second drive gears and, therefore, the first and second agitators are made counter-rotating.

Still more specifically, the gear drive assembly housing includes three pairs of sockets for receiving three intermediate drive gears. In the first selected arrangement the first and second sockets receive two intermediate gears between the first and second drive gears whereby the first and second drive gears and, therefore, the first and second rotary agitators are made counter-rotating. In a second selected arrangement, the third socket receives a single intermediate gear between the first and second drive gears and, therefore, the first and second rotary agitators are made co-rotating. Further, the gear box and the cover include cooperating cavities for receiving bearings on each side of the first and second drive gears to ensure smooth uninterrupted low friction rotation of the first and second agitators.

In accordance with three further aspects of the present invention, an upright vacuum cleaner, an extractor and a power head are provided incorporating the agitator drive system as described.

In accordance with yet another aspect of the present invention, a gear box assembly housing is provided for a vacuum cleaner. The gear box assembly housing includes a gear box and cooperating cover having a projecting lug adjacent a first end thereof for engaging a cooperating slot in a vacuum cleaner housing. Additionally, the gear box assembly housing includes a projecting mounting flange adjacent a second end thereof including an opening for receiving a fastener for securing the gear box assembly to the vacuum cleaner housing. This is an unique and simple mounting engagement that provides reliable and dependable mounting over a long service life at a minimum construction cost.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIG. 3*a* is a partially schematic side elevational view of the agitator drive system with the idler pulley tensioning the belt and the agitators engaged for rotary operation;

Reference will now be made in detail to the present invention, an example of which is illustrated in the accompanying drawing.

DETAILED DESCRIPTION OF THE INVENTION

Figure 1:
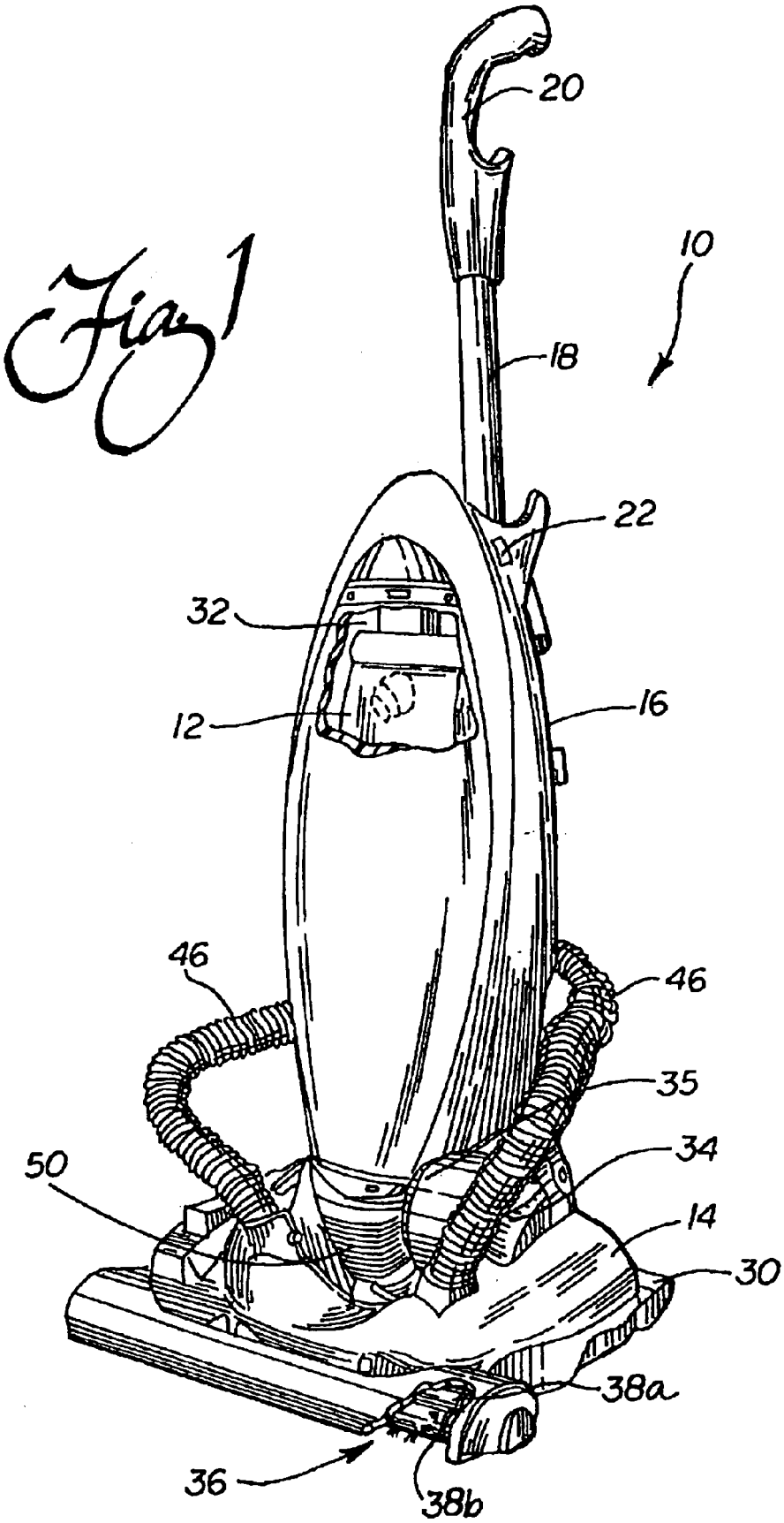
FIG. 1 is a perspective view of an upright vacuum cleaner of the present invention.

Reference is now made to FIG. 1 showing the upright vacuum cleaner 10 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through a cord (not shown).

A pair of rear wheels (not shown) are provided at the lower portion of the canister assembly 16 and a pair of front wheels (not shown) are provided on the nozzle assembly 14. Together, these wheels support the vacuum cleaner 10 for movement across the floor. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated to-and-fro to clean the floor.

The canister assembly 16 includes a cavity 32 adapted to receive and hold a dust bag 12. Alternatively, the vacuum cleaner 10 could be equipped with a dust collection cup such as found on cyclonic type models if desired. Additionally, the canister assembly 16 carries a suction fan 34 and suction fan drive motor 35. Together, the suction fan 34 and its cooperating drive motor 35 function to generate a vacuum airstream for drawing dirt and debris from the surface to be cleaned. While the suction fan 34 and suction fan drive motor 35 are illustrated as being carried on the canister assembly 16, it should be appreciated that they could likewise be carried on the nozzle assembly 14 if desired.

The nozzle assembly 14 includes a nozzle and agitator cavity 36 that houses a pair of rotating agitator brushes 38*a* and 38*b*. The agitator brushes 38*a* and 38*b* shown are rotatably driven by the drive motor 35 through a cooperating belt and gear drive system 60 shown best in FIGS. 2, 3*a* and 3*b* and described in detail below. In the illustrated vacuum cleaner 10, the scrubbing action of the rotary agitator brushes 38*a*, 38*b* and the negative air pressure created by the suction fan 34 and drive motor 35 cooperate to brush and beat dirt and dust from the nap of the carpet being cleaned and then draw the dirt and dust laden air from the agitator cavity 36 to the dust bag 12. Specifically, the dirt and dust laden air passes serially through hoses 46 and/or an integrally molded conduit in the nozzle assembly 14 and/or canister assembly. 16 as is known in the art. Next, it is delivered into the dust bag 12 which serves to trap the suspended dirt, dust and other particles inside while allowing the now clean air to pass freely through to the suction fan 34, pass over the motor 35, through a final filtration cartridge (not shown) and ultimately to the environment through the exhaust port 50.

Figure 2:
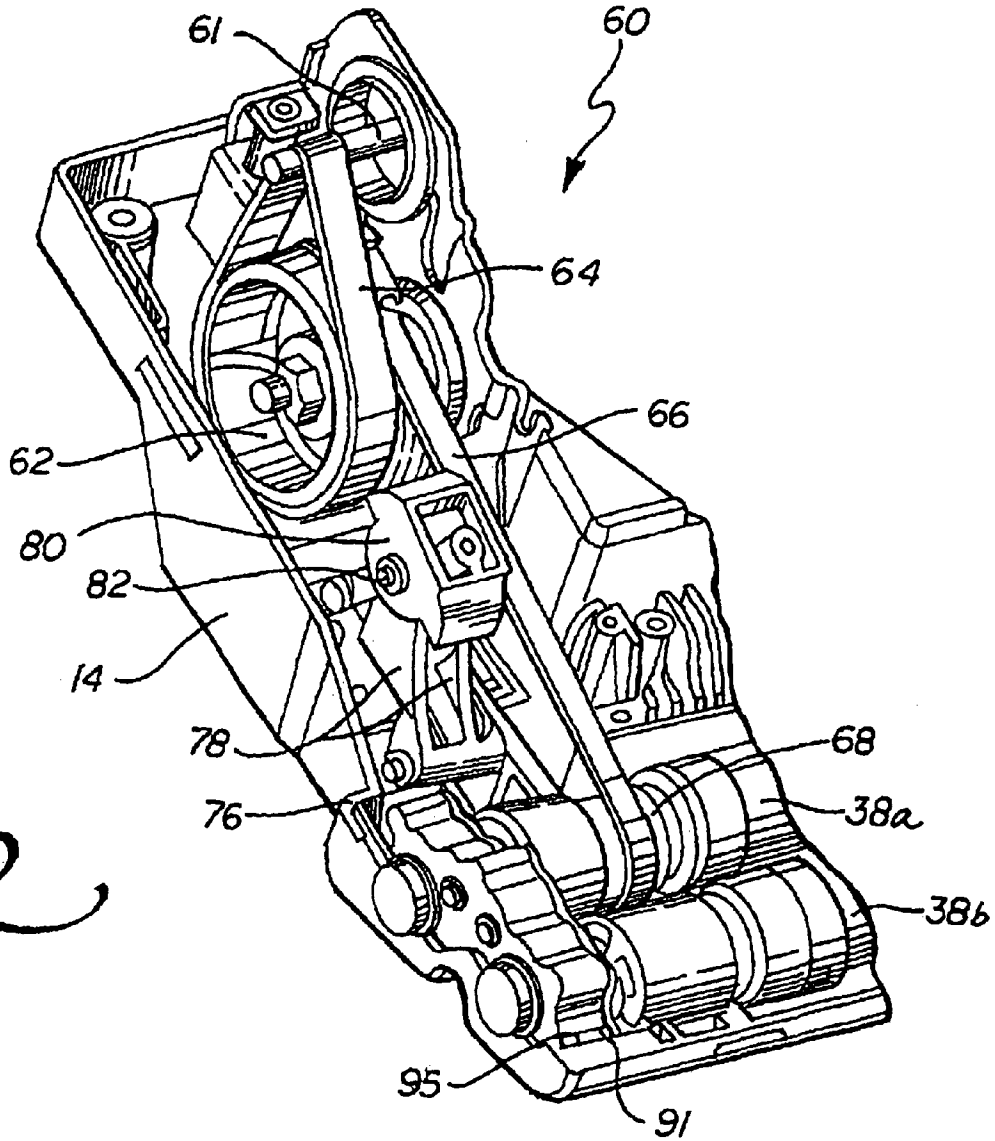
FIG. 2 is an overall detailed perspective view of the agitator drive system of that vacuum cleaner.
Figure 7A:
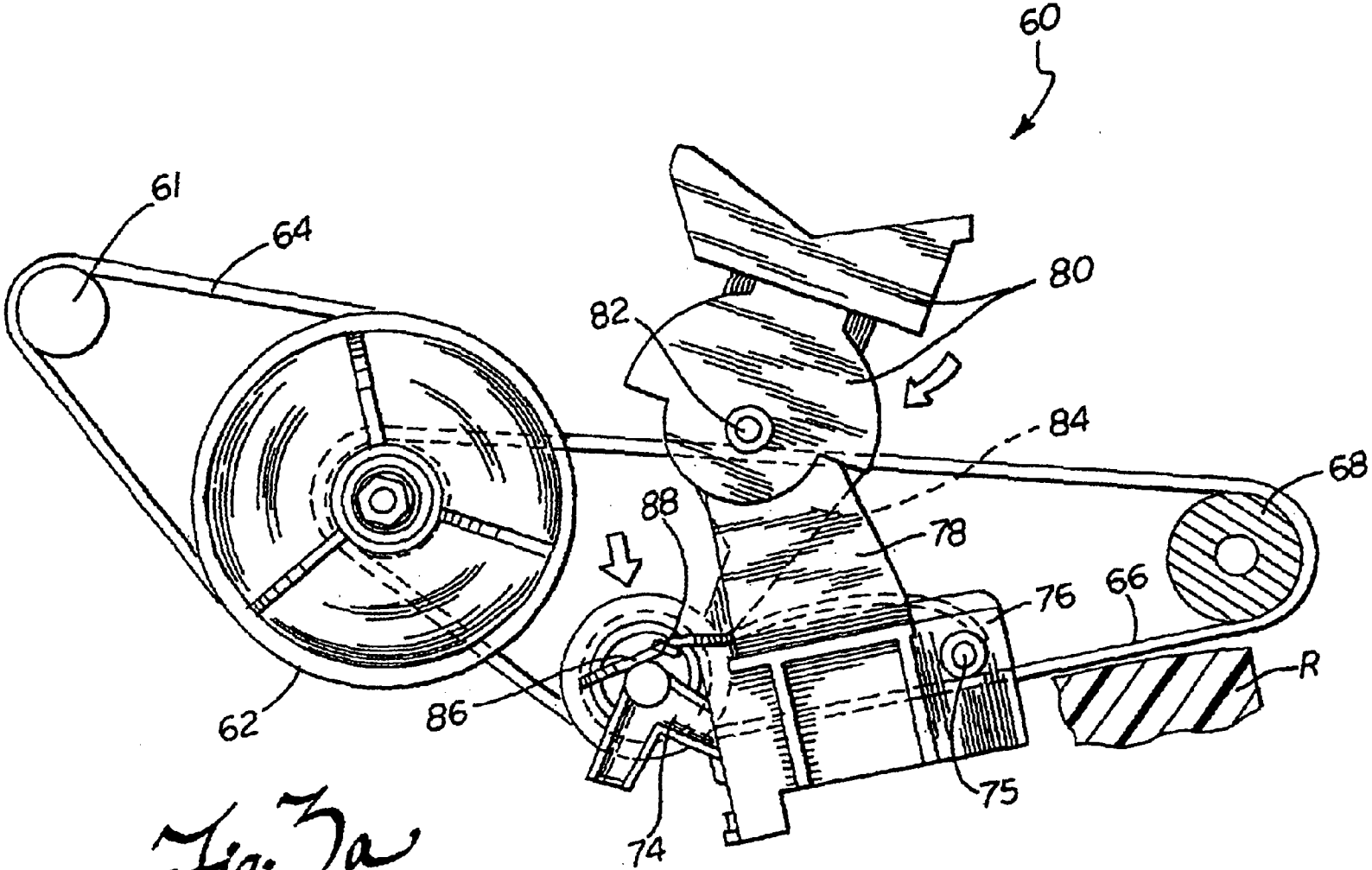
Figure 3B:
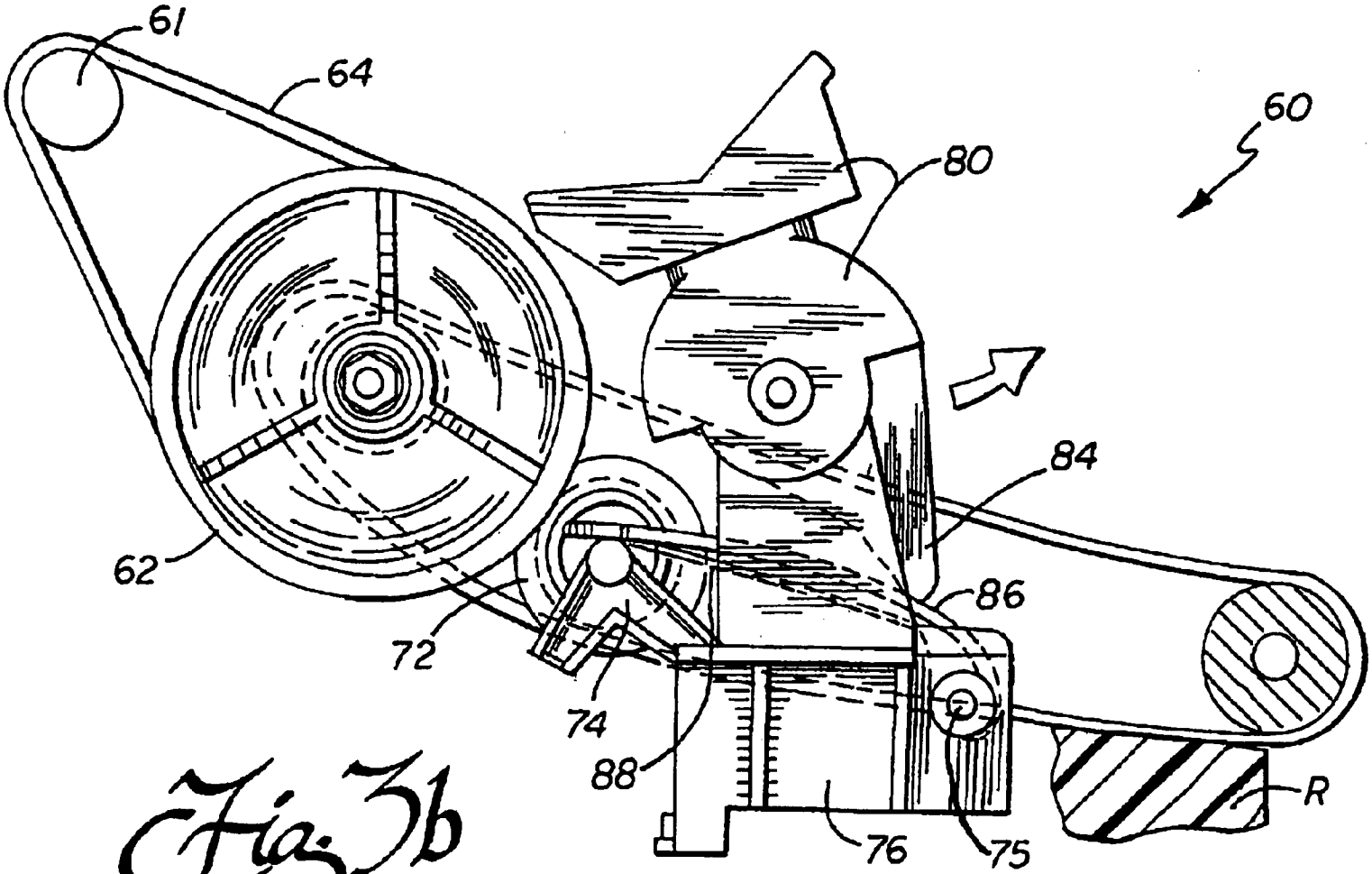
FIG. 3*b* is a view similar to FIG. 3*a* but with the idler pulley released and the agitators disengaged for interruption of drive to the agitators and bare floor cleaning.

The agitator drive system or arrangement 60 shown best in FIGS. 2, 3*a* and 3*b* includes a drive shaft 61 connected to the drive motor 35 that turns the suction fan 34. Drive shaft 61 is connected by a first belt 64 to a dual drive pulley 62 carried for relative rotation on the nozzle assembly 14. A second belt 66 connects the pulley 62 to the agitator pulley 68 carried on the first rotary agitator 38*a*. The dual drive pulley 62 provides a speed reduction so that the rotary agitator 38*a* is driven at optimal speed while the drive motor 35 simultaneously turns the suction fan 34 at the necessary high RPM to generate the desired negative pressure for vacuum cleaning.

The agitator drive system 60 also includes an idler pulley 72 carried on pulley arm 74 that is pivotally mounted by a pin 75 to the mounting bracket 76 secured to the nozzle assembly 14. As illustrated, the mounting bracket 76 includes a pair of spaced upstanding posts 78 upon which a bare floor switch 80 is pivotally mounted by means of a pin 82. The switch 80 includes a downwardly depending finger 84 that engages a leaf spring 86 secured at one end to the pulley arm 74. When the switch 80 is in the carpet cleaning position (see FIG. 3*a*), finger 84 engages and presses downwardly on the spring 86 thereby forcing the pulley arm 74 downwardly. As a result, the idler pulley 72 is positioned to engage the second belt 66 so as to provide the necessary tension to transmit the rotary motion of the drive pulley 62 to the first rotary agitator 38*a*.

In contrast, in the bare floor or second position of the switch 80 (see FIG. 3*b*), finger 84 slips over center along the spring 86 and a coil spring 88 positioned between the mounting bracket 76 and the pulley arm 74 biases the pulley arm upwardly to a second position wherein the idler pulley 72 is disengaged from the second belt 66. This releases tension on the second belt 66 thereby interrupting drive to the first rotary agitator 38*a*. As should be appreciated thus far, only the first rotary agitator 38*a* is driven by the second belt 66. The second rotary agitator 38*b* is driven through a gear drive assembly generally designated by reference numeral 90. As best shown in drawing FIGS. 4, 4*a*, 5 and 5*a*, gear drive assembly 90 includes a gear box 92, a gasket 92*a* and a cooperating cover 94. Gear box 92 includes a projecting lug 91 adjacent a first end thereof and a projecting mounting flange 93 adjacent a second, opposite end thereof. The projecting lug 91 is received and captured in a cooperating slot 95 in the housing of the nozzle assembly 14. The mounting flange 93 includes a slot 97 for receiving a screw fastener (not shown) which engages in a threaded aperture in the housing of the nozzle assembly 14 to complete the connection of the gear drive assembly 90 to the housing.

Gear box 92 also receives a first drive gear 98 connected to the first rotary agitator 38*a* and a second drive gear 100 connected to the second rotary agitator 38*b*. More specifically, the gear box 92 and cover 94 each include cooperating cavities 102 for receiving bearings 104, 106 between which the first and second drive gears 98, 100 are positioned. In the alternative, a combination of bearings and bushings could be used. As further shown, each of the drive gears 98, 100 includes a projecting stub shaft 108 that is slotted, notched or otherwise keyed to the body of the agitators 38*a*, 38*b* respectively.

As further shown with reference to the drawing figures, the gear box 92 and cover 94 include three pairs of sockets 110, 112, 114 each adapted to receive intermediate gears 116, 118, 120 respectively. In a first selected operational arrangement, the first and second pairs of sockets 110, 112, respectively, receive and hold for relative rotation two intermediate gears 118, 120, on shafts 119, 121 respectively. The intermediate gear 118 meshes with the first drive gear 98 and the intermediate gear 120 while the intermediate gear 120 meshes with the intermediate gear 118 and the second drive gear 100. Accordingly, as the second belt 66 rotates the first rotary agitator 38*a* and drive gear 98 in a counterclockwise direction as illustrated in the drawing FIGS. 3*b* and 4*a*, intermediate gear 118 is rotated in a clockwise direction, intermediate gear 120 is rotated in a counterclockwise direction and the second drive gear 100 and second rotary agitator 38*b* keyed thereto are rotated in a clockwise direction.

Figure 4:
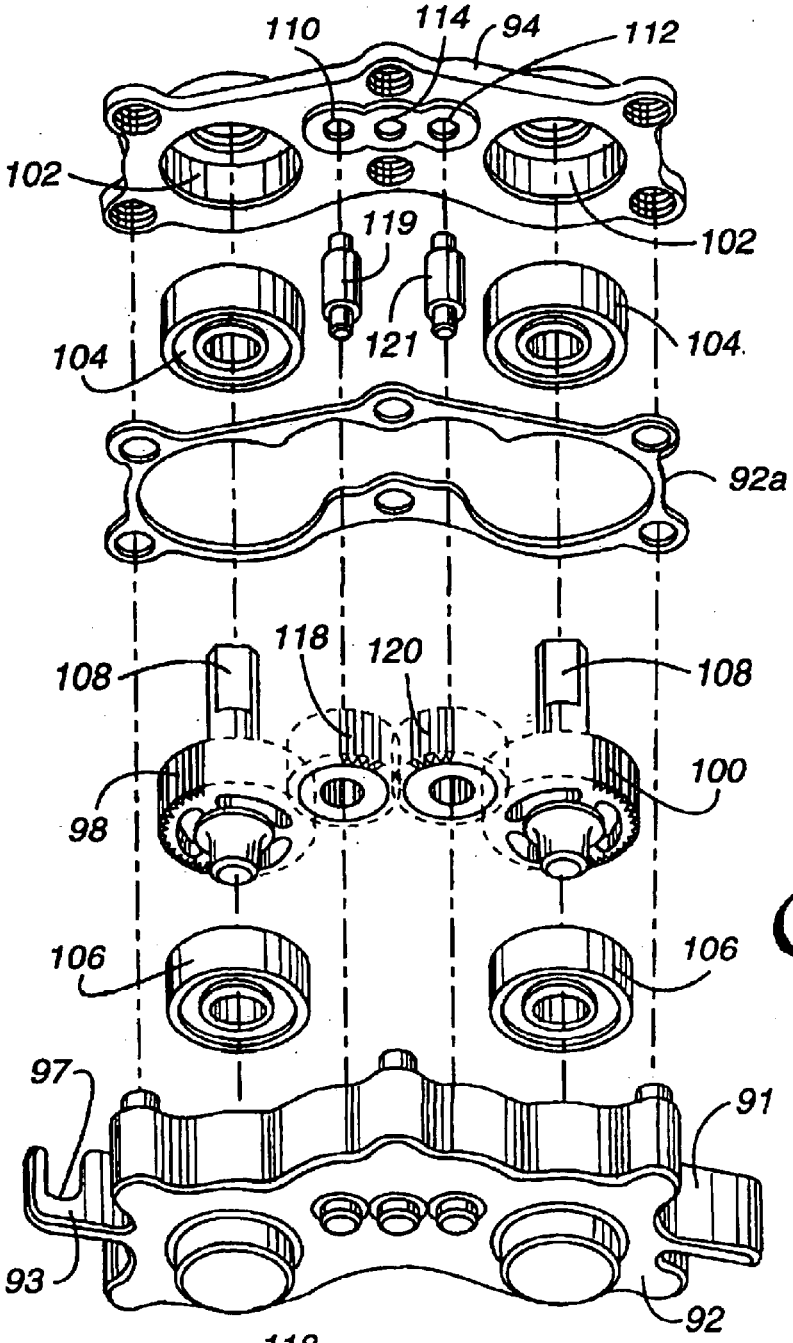
FIG. 4 is an exploded perspective view of the gear drive assembly with the two intermediate gear arrangement to provide counter-rotating agitators.
Figure 4A:
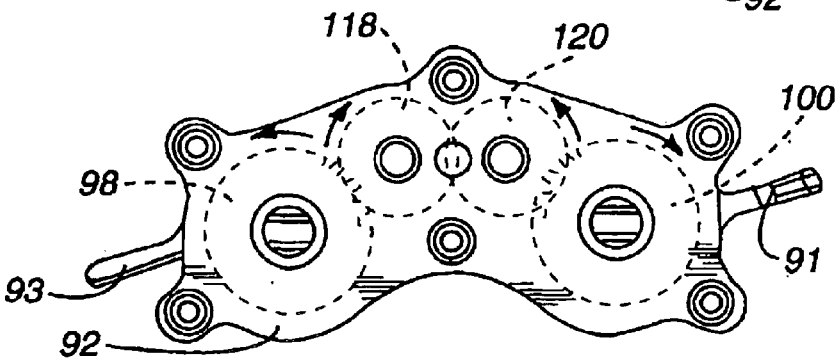
FIG. 4*a* is a side elevational partially schematic view showing the rotary motion of the gears and agitators.
Figure 5:
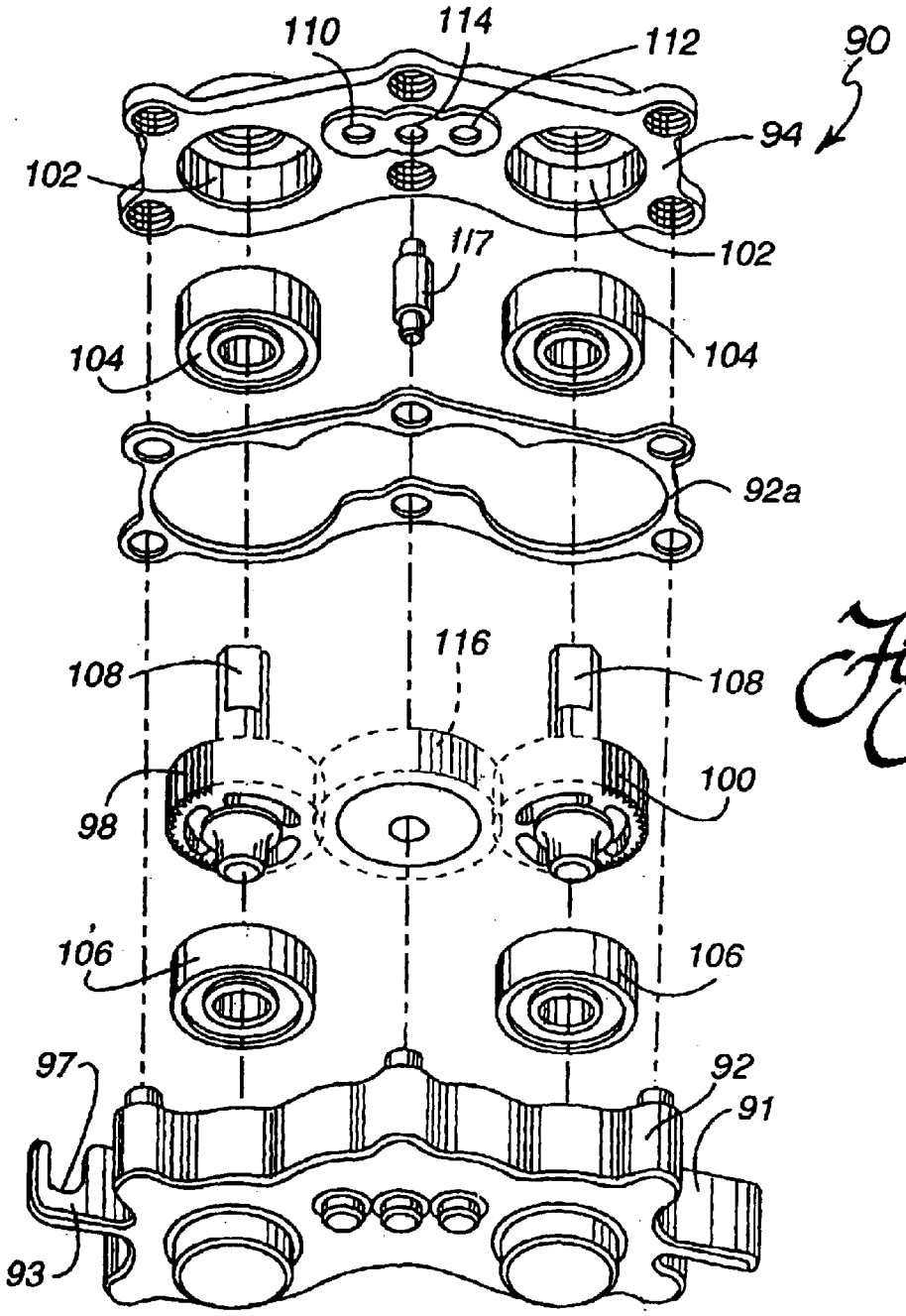
FIG. 5 is an exploded perspective view of the gear drive assembly in the single intermediate gear arrangement whereby the rotary agitators are driven in co-rotating fashion.
Figure 5A:
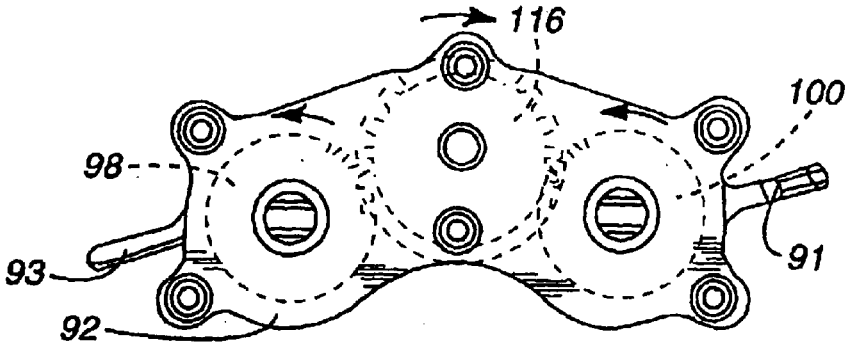
FIG. 5*a* is a side elevational partially schematic view showing the rotary motion of the gears and the agitators.

Thus, when two intermediate gears 118, 120 are provided as illustrated in drawing FIGS. 4 and 4*a*, the rotary agitators 38*a*, 38*b* are counter-rotating. Thus, in the embodiment illustrated the agitators 38*a*, 38*b* rotate toward each other and brush dirt and debris upward from the surface being cleaned into the nozzle assembly 14 through the gap between the agitators. This provides excellent cleaning action. Further, it should be appreciated that the agitators 38*a*, 38*b* are rotated at the same speed and as such the tendency of the first rotary agitator 38*a* to push the vacuum cleaner rearward is fully and equally offset by the tendency of the second rotary agitator 38*b* to pull the vacuum cleaner forward. Accordingly, the rotary agitators 38*a*, 38*b* have no net pushing or pulling effect upon the vacuum cleaner which in the absence of their influence may be more easily manipulated and guided by the operator.

While counter-rotation of the agitators 38*a*, 38*b* toward each other has been illustrated in the drawing FIGS. 4, 4*a*, it should be appreciated that the counter-rotating agitators may also be operated in the reverse direction if desired so that dirt and debris is brushed from the surface being cleaned in opposing directions for drawing up through the nozzle assembly 14 in front of and behind the rotary agitators 38*a*, 38*b*.

Still further, it should be appreciated that the gear drive assembly 90 may also be set up to provide co-rotating agitators 38*a*, 38*b*. More specifically, in this arrangement shown in FIGS. 5 and 5*a*, the intermediate gear 116 is rotatably mounted on a shaft 117 in the third pair of sockets 114 between the first drive gear 98 and the second drive gear 100. The intermediate gear 116 meshes with both of the drive gears 98, 100. Thus, in the event the first rotary agitator 38*a* is driven by the motor 35 in a counterclockwise direction as illustrated in drawing FIG. 5*a*, the intermediate gear 116 is driven in a clockwise direction. This causes the second drive gear 100 to also be driven in a counterclockwise direction and, accordingly, the first and second rotary agitators 38*a*, 38*b* are co-rotating. Of course, while the co-rotating of the agitators in a counter-clockwise direction is illustrated, it should be appreciated that the two agitators may also be co-rotated in a clockwise direction if desired.

By providing a gear drive assembly 90 for driving the second rotary agitator 38*b* off of the first rotary agitator 38*a*, belt drive need only be provided to the first rotary agitator. This advantageously eliminates complicated routing of the belt across both agitators. Further, it should be appreciated that more efficient and complete cleaning is possible than with a vacuum cleaner having both agitators driven by a single belt. This is because the pulley area of each agitator in such a design must be devoid of carpet cleaning structures. This leaves an unbrushed or unbeaten gap of carpet as the vacuum cleaner moves.

In contrast, while the first agitator 38*a* includes a belt pulley 68 and, therefore, cannot include any carpet cleaning structures such as beater bars, brushes, wipers or bristles in the pulley area, the second agitator 38*b* includes such cleaning structures across its entire width including, particularly, in the area 69 immediately aligned with and corresponding to the belt pulley of agitator 38*a* (note tufts of bristles 71 illustrated in FIG. 2). This provides for complete, highly efficient cleaning. There is no pulley area gap in the present invention and as a consequence, there is no unbrushed or unbeaten gap of carpet when the vacuum cleaner is moved to and fro.

In summary, numerous benefits result from employing the concepts of the present invention. A smooth and efficient agitator drive arrangement is provided for a twin agitator equipped vacuum cleaner or extractor. The system provides full cleaning across the entire width of the nozzle assembly. Further, the gear drive assembly 90 is arranged in such a manner that by simply selecting one of two possible alternative drive arrangements, the twin rotary agitators 38*a*, 38*b* may be made counter-rotating or co-rotating depending upon the desires of the vacuum cleaner/extractor manufacturer. Inventory and parts control advantages are realized since a single gear box 92, cover 94 and first and second drive gears 98, 100 need be stocked. Only the intermediate drive gears 116, 118 and 120 need be swapped to convert between counter-rotating and co-rotating agitators.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the belt and pulley assembly could comprise a pulley on the motor drive shaft, a pulley on the agitator and a single belt between these two pulleys. Further, while an upright vacuum cleaner is illustrated, an extractor or even the power head of a canister vacuum cleaner could be equipped with the agitator drive system of the present invention.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An agitator drive system, comprising:

a housing;

a first rotary agitator earned on said housing;

a second rotary agitator carried on said housing;

a drive motor curried on said housing;

a belt and pulley assembly connecting said drive motor directly to said first rotary agitator wherein said belt and pulley assembly includes a drive shaft, a drive pulley, a first belt connecting said drive shaft to said drive pulley and a second belt connecting said drive pulley to said first rotary agitator; and a gear drive assembly connecting said first rotary agitator to said second rotary agitator.

2. The agitator drive system of claim 1, including a pivotally mounted idler pulley selectively displaceable between a first position wherein said idler pulley engages and tensions said second belt and a second position wherein said idler pulley releases tension from said second bolt.

3. An agitator drive system, comprising:

a housing;

a first rotary agitator carried on said housing;

a second rotary agitator carried on said housing;

a drive motor carried on said housing;

a belt and pulley assembly directly connecting said drive motor to said first rotary agitator; and a gear drive assembly connecting said first rotary agitator to said second rotary agitator, wherein said gear drive assembly includes a gear box and cooperating cover, a first drive gear connected to said first rotary agitator and a second drive gear connected to said second rotary agitator.

4. The agitator drive system of claim 3, wherein said gear drive assembly includes a single intermediate gear between said first and second drive gears whereby said first and second drive gears are made co-rotating.

5. The agitator drive system of claim 3, wherein said gear drive assembly includes two intermediate gears between said first and second drive gears whereby said first and second drive gears are made counter-rotating.

6. The agitator drive system of claim 3, wherein said gear drive assembly gear box and cooperating cover includes three pairs of socket for receiving three intermediate drive gears;

in a first selected arrangement said first and second sockets receiving two intermediate gears meshing with said first and second drive gears whereby said first and second drive gears are made counter-rotating; and in a second selected arrangement said third socket receiving a single intermediate gear meshing with said first and second drive gears whereby said first and second drive gears are made co-rotating.

7. The agitator drive system of claim 3, wherein said gear box and said cover include cooperating cavities for receiving bearings on each side of said first and second drive gear.

8. An upright vacuum cleaner/extractor, comprising;

a housing;

a nozzle opening in said housing;

a dust collector carried on said housing;

a suction fan carried on said housing, said suction fan drawing air, dirt and debris from a surface to be cleaned through the nozzle opening to sand dust collector;

a first rotary agitator carried on said housing;

a second rotary agitator carried on said housing;

a drive motor carried on said housing driving said suction fan;

a belt and pulley assembly connecting said drive motor directly to said first rotary agitator; and a gear drive assembly connecting said first rotary agitator to said second rotary agitator.

9. The upright vacuum cleaner/extractor of claim 8, wherein said gear drive assembly includes a gear box and cooperating cover, a first drive gear connected to said first rotary agitator and a second drive gear connects to said second rotary agitator.

10. The upright vacuum cleaner/extractor of claim 9, wherein said gear drive assembly includes a single intermediate gear between said first and second drive gears whereby said first and second drive gears are made co-rotating.

11. The upright vacuum cleaner/extractor of claim 9, wherein said gear drive assembly includes two intermediate gears between said first and second drive gears whereby said first and second drive gears are made counter-rotating.

12. The upright vacuum cleaner/extractor of claim 9, wherein said gear drive assembly gear box and cooperating cover includes three pairs of sockets for receiving three intermediate drive gears;

in a first elected arrangement said first and second sockets receiving two intermediate gears meshing with said first and second drive gears whereby said first and second drive gears are made counter-rotating; and in a second selected arrangement said third socket receiving a single intermediate gear meshing with said first and second drive gears whereby said first and second drive gears are made co-rotating.

13. The upright vacuum cleaner/extractor of claim 9, wherein said gear box and said cover include cooperating cavities for receiving bearings on each side of said first and second drive gears.

14. An upright vacuum cleaner/extractor, comprising:

a housing;

a nozzle opening in said housing;

a dust collector carried on said housing;

a suction fan carried on said housing, said suction fan drawing air, dirt and debris from a surface to be cleaned through the nozzle opening to said dust collector;

a first rotary agitator carried on said housing;

a second rotary agitator carried on said housing;

a drive motor carried on said housing;

a belt and pulley assembly connecting said drive motor to said first rotary agitator wherein said belt and pulley assembly includes a drive shaft, a drive pulley, a first belt connecting said drive shaft to said drive pulley and a second belt connecting said drive pulley to said first rotary agitator; and a gear drive assembly connecting first rotary agitator to said second rotary agitator.

15. The upright vacuum cleaner/extractor of claim 14, including a pivotally mounted idler pulley selectively displaceable between a first position wherein said idler pulley engages and tensions said second belt and a second position wherein said idler pulley releases tension from said second belt.

16. A gear box assembly housing for a vacuum cleaner/extractor, comprising:

gear box and a cooperating cover having a projecting hag adjacent a first end thereof for engaging a cooperating slot in a vacuum cleaner housing and a projecting mounting flange adjacent a second end thereof including an opening for receiving a fastener for securing said gear box assembly to said vacuum cleaner housing.

17. A power head, comprising:

a housing;

a nozzle opening in said housing;

a first rotary agitator carried on said housing;

a second rotary agitator carried on said housing;

a drive motor carried on said housing;

a belt and pulley assembly connecting said drive motor directly to said first rotary agitator wherein said belt and pulley assembly includes a drive shaft a drive pulley a first belt connecting said drive shaft to said drive pulley and a second belt connecting said drive pulley to said first rotary agitator; and a gear drive assembly connecting said first rotary agitator to said second rotary agitator.

18. The power head of claim 17, including a pivotally mounted idler pulley selectively displaceable between a first position wherein said idler pulley engages and tenuous said second belt and a second position wherein said idler pulley releases tension from said second belt.

19. The power head of claim 17, wherein said gear drive assembly includes a gear box and cooperating cover, a first drive gear connected to said first rotary agitator and a second drive gear connected to said second rotary agitator.

20. The power head of claim 19, wherein said gear drive assembly includes a single intermediate gear between said first and second drive gears whereby said first and second drive gears are made co-rotating.

21. The power head of claim 19, wherein said gear drive assembly includes two intermediate gears between said first and second drive gears whereby said first and second drive gears are made counter-rotating.

22. The power head of claim 19, wherein said gear drive assembly gear box and cooperating cover includes three pair of sockets for receiving three intermediate drive gears;

in a first selected arrangement said first and second sockets receiving two intermediate gears meshing with said first and second drive gears whereby said first and second drive gears are made counter-rotating; and in a second selected arrangement said third socket receiving a single intermediate gear meshing with said first and second drive gears whereby said that said second drive gears are made co-rotating.

23. The power head of claim 19, wherein said gear box and said cover include cooperating cavities for receiving bearings on each side of said first and second drive gears.

* * * * *

UNITED STATES PATENT AND TRADEMARK OFFICE

CERTIFICATE OF CORRECTION

PATENT NO. : 6,915,544 B2
DATED : July 12, 2005
INVENTOR(S) : Roney et al.

It is certified that error appears in the above-identified patent and that said Letters Patent is hereby corrected as shown below:

Column 8,
Line 31, please replace “elected” with -- selected --.

Column 9,
Line 3, please replace “hag” with -- lug --.
Line 25, please replace “tenuous” with -- tensions --.

Column 10,
Line 22, please replace “that said” with -- first and --.

Signed and Sealed this

Fourth Day of October, 2005

JON W. DUDAS
*Director of the United States Patent and Trademark Office*